United States Patent [19]

Savioli

[11] Patent Number: 4,598,490

[45] Date of Patent: Jul. 8, 1986

[54] AMMUNITION MAGAZINE

[75] Inventor: Giulio V. Savioli, Andover, N.J.

[73] Assignee: The United States of America as represented by the Secretary of the Army, Washington, D.C.

[21] Appl. No.: 548,903

[22] Filed: Nov. 4, 1983

[51] Int. Cl.[4] ..... F41C 25/02; F41C 25/08

[52] U.S. Cl. ..... 42/50; 89/33.1

[58] Field of Search ..... 42/50, 49 R, 18, 22; 89/33.1

[56] References Cited

U.S. PATENT DOCUMENTS 3,322,036 5/1967 Jäfwert ..... 89/33.1 X 3,672,089 6/1972 Silsby ..... 42/50

FOREIGN PATENT DOCUMENTS 616909 9/1946 United Kingdom ..... 89/33.1

*Primary Examiner*—David H. Brown

*Attorney, Agent, or Firm*—Anthony T. Lane; Robert P. Gibson; Edward F. Costigan

[57] ABSTRACT

An ammunition magazine for an automatic weapon wherein a spring-loaded column of successive cartridges are each fed in alignment to a firing chamber upon the reciprocating action of a bolt. The magazine has a pair of feed-gates, each of which is pivotally mounted on the magazine. The upper ends of the feed-gates together form a semi-circular, separably engaged, retaining cover for the top cartridge in the magazine. The lower ends of the feed-gates in sequence separably engage the next successive round in the magazine in response to the pivotal movement of the upper ends of both gates. This latter action keeps the successive round out of contact with the bolt while the top round is stripped and fed into the firing chamber by the bolt.

1 Claim, 7 Drawing Figures

AMMUNITION MAGAZINE

The invention described herein may be manufactured, used and licensed by or for the Government for Governmental purposes without the payment to me of any royalties thereon.

BACKGROUND OF INVENTION

This invention relates to an improved ammunition magazine for an automatic weapon.

More particularly, this invention relates to a ammunition magazine having pivotal gates for use in feeding cartridges into a firing chamber of a automatic weapon in response to the reciprocating action of a bolt.

DESCRIPTION OF THE PRIOR ART

The state of the art provides the use of molded caseless ammunition for efficiency, cost, and effectiveness in normal automatic weaponry. Conventional magazines for ammunition having brass casings require that the cartridge be feed at an upward angle in travel to the firing chamber upon the action of a reciprocating bolt. However, traditional methods of feeding are at a disadvantage in the case of molded caseless ammunition. This is because the molded propellent in the ammunition has poor strength characteristics, and may be damaged during the upward feeding of the same into the firing chamber. Many times, conventional feeding renders the molded caseless cartridge useless.

It is required that molded cartridges not be damaged during the feed process to prevent a jammed weapon or misfire. Ammunition with brass casings have strength and can be fed at an angle into the chamber. However, molded cartridges are subject to breakage or marring of the molded body during feeding with conventional magazines. For the molded round, the feed should be in straight alignment with the chamber for the cited reasons.

Further, with automatic weapons which could fire up to 2000 rounds per minute, it has been found that the reciprocating bolt gets extremely heated. Precautions must be taken to prevent the successive molded cartridges from coming in contact with the body of the bolt. If contact is maintained between the cartridges and the bolt for any length of time, the ammunition in the magazine may ignite when it reaches its cook-off temperature.

SUMMARY OF INVENTION

This invention answers the needs of the art with special provision for proper alignment of the cartridges with the firing chamber, and the reduction of contact with the bolt avoiding the attainment of a cook-off temperature for the successive round.

Specifically, the invention is an ammunition magazine for an automatic weapon. A spring-loaded column of successive rounds or cartridges are each fed in alignment to a firing chamber upon the reciprocating action of a bolt. The improvement is a set of feed gates, each of which is pivotally mounted on the magazine. The upper end of each of the feed gates together form a semi-circular, separably engaged, retaining cover for a first cartridge. The lower end of each of the feed gates has an edge or finger which in sequence separably engage the next successive cartridge or round in response to pivotal movement of the upper ends of both gates.

It is therefore an object of this invention to provide a magazine for molded ammunition which will not render the round damaged when feeding the same into the firing chamber.

Another object is to provide a magazine for ammunition which will feed the molded cartridge or round in proper alignment to the chamber of the weapon.

A still further object is to provide an ammunition magazine with provision against the cook-off of the molded caseless round.

Other and further objects will become more apparent from the following specification when taken in conjunction with the drawings, wherein.

Figure 4:
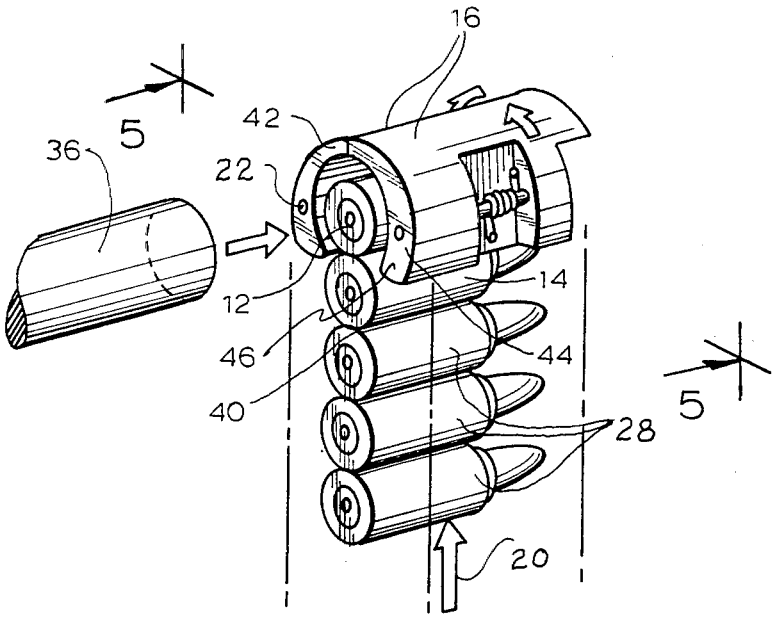

FIG. 4. is a view showing the relationship of the bolt and magazine.

Figure 5:
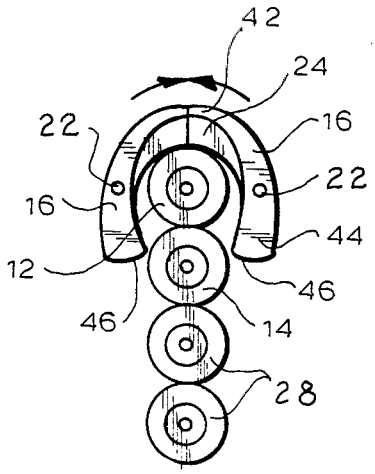

FIG. 5 a view taken on line 5—5 of FIG. 4.

Figure 6:
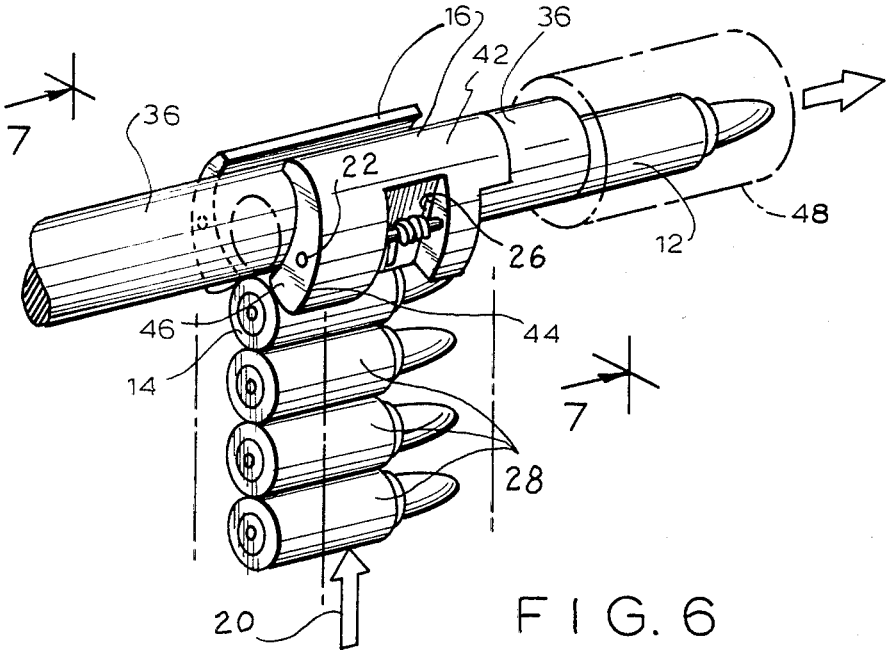

FIG. 6 is a view of FIG. 4 in the open position showing the relationship of the bolt, magazine and firing chamber.

Figure 7:
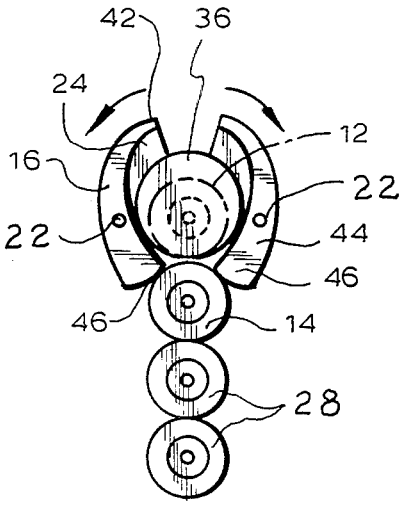

FIG. 7 is a view taken on line 7—7 of FIG. 6.

DESCRIPTION OF PREFERRED EMBODIMENT

Figure 1:
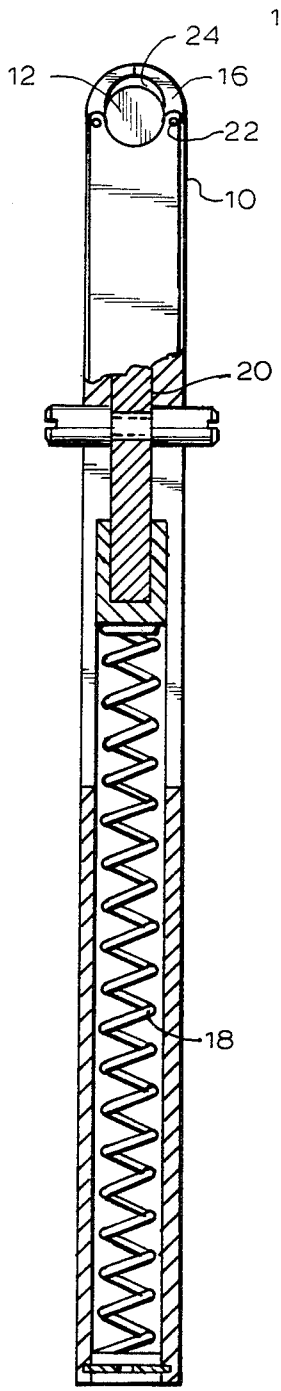
FIG. 1 is a front view of the magazine of this invention.

Referring to FIG. 1, an ammunition magazine 10 is shown for storing, positioning, and controlling cartridges being fed into the chamber of a weapon. This magazine is unique in that, when inserted into a weapon, it positions the cartridge 12 in alignment with the chamber itself and this is highly desirable for caseless molded ammunition. In addition, it controls the position of the second successive round when the top or first round is being fed into the chamber and fired. As shown, the typical magazine 10 is provided with alignment gates 16 of this invention. Clearly, the gates 16 are in the closed position prior to insertion into the weapon or when the weapon bolt is open. In this position, the gates 16 form a semi-circular, separably engaged, retaining cover for the top or first round 12. The lower cut away section shows the spring loaded. device 18 acting on a pusher 20 which feeds the cartridge into the gate section 16. The pivotal nature of the gates 16 is maintained by a pin 22 secured on the magazine itself. A cam section of each of the gates is shown at 24 above the cartridge or round 12.

Figure 2:
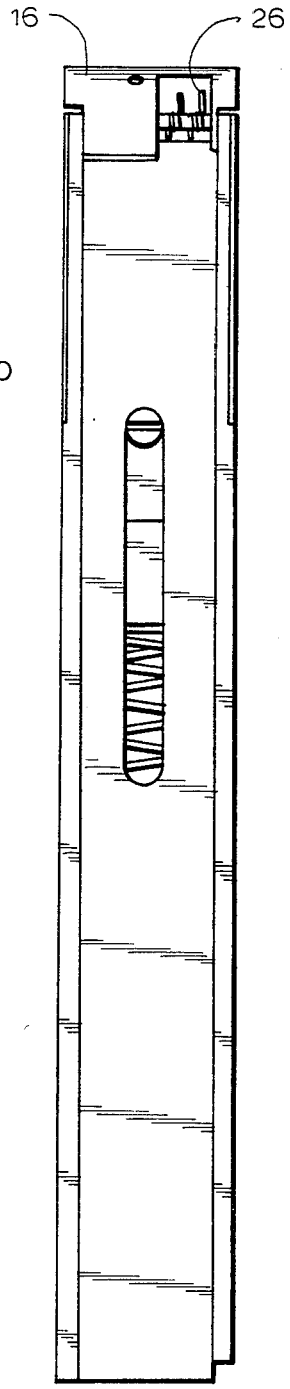
FIG. 2 is a side view of the magazine of FIG. 1.

As shown in FIG. 2, the gates are spring loaded at 26 to maintain their position as a retaining cover for the top or first round. The gates are normally positioned in the closed position allowing the cartridges to be fed upwardly.

Figure 3:
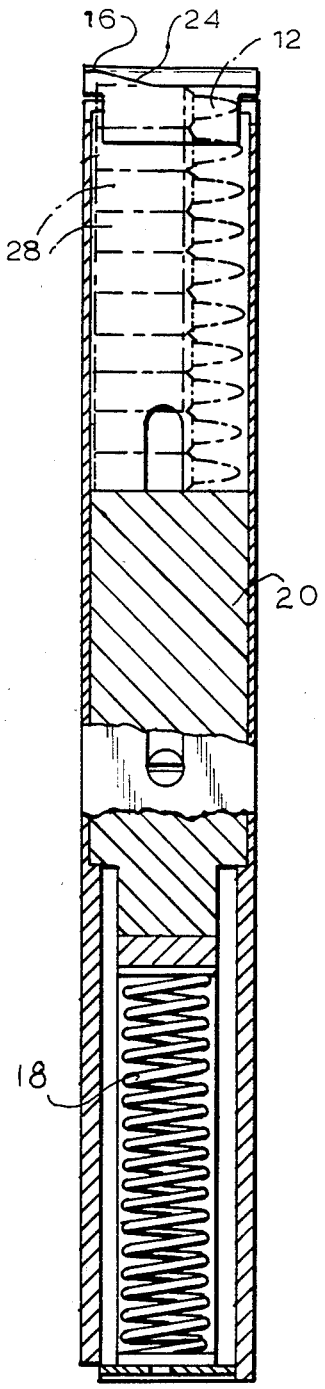
FIG. 3 is a partial side view of FIG. 1 with section cutaway showing the interior of the magazine.

Referring now to FIG. 3, the successive rounds or cartridges 28 are shown being acted on by a pusher 20. The first cartridge or round 12 is shown relative the cam section 24 of the gates 16.

As shown in FIG. 4, the improved ammunition magazine has a spring loaded column of successive cartridges 28, each to be fed in alignment to a firing chamber upon the reciprocating action of a bolt 36 in forward or rearward movements. Cartridge positioning is accomplished by a spring loaded pusher 20 which applies a load against the stack of ammunition. Prior to the entrance of the bolt 36 into the gates 16, the latter form a semi-circular retaining cover for the first round 12 of the successive series of cartridges 28. Cartridge control is accomplished by the spring-loaded gates 16 themselves. Each spring-loaded feed gate is pivotally mounted by means of a pin 22 on the magazine 10. The gates have upper 42 and lower ends 44. The upper ends 42 form the retaining cover, while the lower ends 44 have an inner edge or finger 46 which separably engage in sequence with the second successive round 14 or cartridge when the upper ends 42 of the gates 16 pivot about the pins 22.

Referring to FIG. 5, the cam surface 24 of the gates 16 will contact the bolt 36 as it enters the gates 16. This action will facilitate the opening of the gates 16, as the bolt 36 pushes the first round 12 out of the gates into the chamber of the weapon.

As seen in FIGS. 6 and 7, as the bolt 36 moves forward it pivotally opens the gates 16, and pushes the first round out. In this sequence, the bolt contacts the cam surface 24, and the gates are separated by pivoting on the pins 22. The lower ends or fingers 46 of each gate 16 pivotally engage the second successive cartridge 14 when the upper ends 42 of the gates 16 pivot out of engagement over the first round 12. As a result of the bolt 36 moving forward, the gates 16 open, the first round 12 is stripped by the bolt 36, and is feed in proper alignment into the chamber 48. When the gates open, the lower end or finger 46 block the next round 14 from its upward movement at a safe distance from the heated body of the bolt. This action holds that round 14 in position away from the bolt 36 and prevents cook-off of the round. When the chambered cartridge 12 is fired, the bolt 36 moves rearward until it clears the gate 16 which snap closed under spring 26 action. In this sequence, upon withdrawal of bolt 36 from the gates 16, the upper end 42 of each of the gates 16 pivot into engagement again over the next cartridge 14 of the spring loaded successive series of cartridges. Due to this pivot action of the spring-loaded gates 16, the lower ends 46 of each of the gates 16 pivot out of engagement with the successive cartridge 14. As a result, the latter cartridge is pushed into the top or feed position 12 by the spring-loaded nature of the arrived at.

As may be seen from the aforesaid description and drawings, a novel magazine for ammunition is shown with provision for proper feed alignment of the cartridges into the chamber of a weapon. Further, misfire or jam of the weapon is avoided because of this provision of proper alignment without the necessity of upward travel of the cartridge to the firing chamber. Also, the provision of spaced relationship between the bolt and the successive rounds avoids the latter from reaching a cook-off temperature or misfire in the magazine itself.

I claim:

1. In an ammunition magazine for an automatic weapon wherein a spring-loaded column of successive cartridges are each fed in alignment to a firing chamber upon the reciprocating action of a bolt, the improvement comprising:

a pair of feed gates each gate of which is pivotally mounted on said magazine, said feed gates each having an upper and lower end;

said feed gates having a cam inner surface on said upper ends provided for contact by said bolt of said weapon, said cam surface upon contact by said bolt pivotally opens said upper ends of said gates for feeding said first cartridge into said chamber of said weapon, said upper ends of said gates together forming a semicircular, separable engaged, retaining cover for a first cartridge, and said lower ends of said gate being separable engaged in sequence with a second successive cartridge in response to pivotal movement of said upper ends of said gates.

* * * * *